US008292532B2

(12) United States Patent
Nasu et al.

(10) Patent No.: US 8,292,532 B2
(45) Date of Patent: Oct. 23, 2012

(54) PROPELLING CONTAINER

(75) Inventors: Mieko Nasu, Yokohama (JP); Hiroshi Mizushima, Tokyo (JP); Takayuki Goto, Tokyo (JP)

(73) Assignees: Shiseido Company., Ltd., Tokyo (JP); Yoshino Kogyosho Co., Ltd., Tokyo (JP)

( * ) Notice: Subject to any disclaimer, the term of this patent is extended or adjusted under 35 U.S.C. 154(b) by 430 days.

(21) Appl. No.: 12/450,163

(22) PCT Filed: Dec. 17, 2007

(86) PCT No.: PCT/JP2007/074231

§ 371 (c)(1),
(2), (4) Date: Oct. 13, 2009

(87) PCT Pub. No.: WO2008/111276

PCT Pub. Date: Sep. 18, 2008

(65) Prior Publication Data

US 2010/0104345 A1 Apr. 29, 2010

(30) Foreign Application Priority Data

Mar. 15, 2007 (JP) ..... 2007-067185
Apr. 27, 2007 (JP) ..... 2007-119781
Jun. 12, 2007 (JP) ..... 2007-155415
Nov. 27, 2007 (JP) ..... 2007-305353

(51) Int. Cl.
*B43K 5/06* (2006.01)

(52) U.S. Cl. ..... 401/175; 401/171; 401/172

(58) Field of Classification Search ..... 401/175, 401/171, 172, 75, 80, 84, 261, 262, 263, 401/265; 215/294, 342, 350, 351
See application file for complete search history.

(56) References Cited

U.S. PATENT DOCUMENTS 1,986,394 A * 1/1935 Pietro ..... 401/175
4,310,101 A * 1/1982 Sekine ..... 215/330
4,521,127 A 6/1985 Tomburo et al.

(Continued)

FOREIGN PATENT DOCUMENTS

JP U-4-71676 6/1992

(Continued)

OTHER PUBLICATIONS

European Search Report dated Dec. 9, 2010 in corresponding European Patent Application No. 07 850 719.1.

(Continued)

*Primary Examiner* — David Walczak
(74) *Attorney, Agent, or Firm* — Oliff & Berridge, PLC

(57) ABSTRACT

A propelling container with an inner cylinder, a dispenser head, an inner plate, an annular sealing member, a rotator and a lid body. The rotator has a bottom wall part connected to a lower end of the connecting rod, and a circumferential wall part extending from a periphery of the bottom wall part along an outer face of the inner cylinder and surrounding the inner cylinder, thereby rotatably held by the inner cylinder. The rotator is provided with an elastic body repeatedly contacted with and moved away from a projection of the inner cylinder upon rotation of the rotator to generate a click feeling. A stopper is arranged on a base part of the screw rod and associated with a lower part of the inner plate when the inner plate is positioned at the lowest end of the content filling space, so that rotation of the rotator is prevented.

6 Claims, 11 Drawing Sheets

U.S. PATENT DOCUMENTS

| | | | | |
|---|---|---|---|---|
| 5,772,347 | A | 6/1998 | Gueret | |
| 5,803,288 | A * | 9/1998 | Munini | 215/342 |
| 5,947,621 | A | 9/1999 | Szekely | |

FOREIGN PATENT DOCUMENTS

| | | |
|---|---|---|
| JP | A-8-229461 | 9/1996 |
| JP | A-8-229462 | 9/1996 |
| JP | A-9-65925 | 3/1997 |
| JP | A-10-203547 | 8/1998 |
| JP | A-10-264954 | 10/1998 |
| JP | A-2000-103481 | 4/2000 |
| JP | B2-3403727 | 5/2003 |
| JP | A-2005-168745 | 6/2005 |
| JP | U-3113830 | 9/2005 |
| JP | U-3113855 | 9/2005 |
| JP | A-2006-219174 | 8/2006 |
| WO | WO 00/60978 A1 | 10/2000 |

OTHER PUBLICATIONS

Office Action issued in Chinese Patent Application No. 200780052904.7 dated Jun. 24, 2011 (with translation).

Aug. 29, 2011 Office Action issued in Korean Patent Application No. 10-2009-7020453 (with translation).

Aug. 7, 2012 Office Action issued in Japanese Patent Application No. 2007-155415 (with translation).

* cited by examiner

A–A

C–C

B-B

D-D

PROPELLING CONTAINER

TECHNICAL FIELD

The present invention relates to a propelling container for discharging a content in the container from an opening of a dispenser head by sliding an inner plate to press or lift the content.

RELATED ART

As an example of such a conventionally known propelling container for appropriately propelling a content by rotating a dial (rotator) attached to a container body, a container filled with a lipstick, a lip balm, a stick-type adhesive or the like can be recited by way of example.

Recently, as a container of this kind, containers have been developed for accommodating a content such as a viscous cosmetic material and extruding and discharging it from a discharge hole of a dispenser head by means of an inner plate placed in the container (see, for example, Japanese Patent application Laid-open No. H8-229461 as well as Japanese Patent application Laid-open No. 2005-168745). Such a container is frequently used for accommodating creamy cosmetic materials, hair cosmetics, antiperspirants or the like with relatively low viscosity. Recently developed products adopt a system which not only propels the content, but also discharges a proper amount of the content from the discharge hole of the dispenser head to apply the content (see, for example, Japanese Patent No. 3403727).

The conventional propelling containers as disclosed in the above documents comprise a dial such as actuation ring, rotator or the like which is smoothly rotated around the container body, which makes it difficult to recognize the amount of the content propelled. Besides, a force to slide the inner plate further downward can be applied by wrong operation of the dial even if the inner plate is already positioned at the lowermost end of the container body, so that component members or the like constituting a propelling mechanism can be damaged.

Due to a wrong rotation of the propelling mechanism or a residual pressure in the container body, the content can be lifted and leaked out into a gap between a cap and a head even if the cap is attached. The content can be flow out of the opening depending on the viscosity of the content when the container is laid on its side. Therefore, it is demanded to improve sealing performance of this part.

DISCLOSURE OF THE INVENTION

It is therefore an object of the present invention to provide a novel and highly air-tight propelling container which enables to easily recognize the amount of the content propelled, and to reliably prevent the components from being damaged by a wrong operation of the dial, and can be filled with and hold the content regardless of the nature of the content.

Another object of the present invention is to provide a novel propelling container which can reliably prevent the leakage of the content.

The present invention provides a propelling container comprising:

an inner cylinder having a screw rod rotatably standing on a bottom part of the inner cylinder, and an inner space surrounded by a side wall and serving as a content filling space;

a dispenser head detachably attached to a mouth part of the inner cylinder and having at least one discharge hole communicated with the content filling space;

an inner plate threadedly engaged with the screw rod and having an annular sliding band elastically contacted with an inner face of the side wall of the inner cylinder;

an annular sealing member arranged in the inner plate for keeping an air tight state between the inner plate and the screw rod;

a rotator for rotating the screw rod via the connecting rod to slide the inner plate along an axis of the screw rod with the air tight state being kept so that the content in the content filling space is lifted and discharged from the dispenser opening of the dispenser head; and a lid body detachably engaged with an upper part of the inner cylinder to accommodate the dispenser head therein, and is characterized in that the rotator comprises a bottom wall part connected to a lower end of the connecting rod, and a circumferential wall part extending from a periphery of the bottom wall part along an outer face of the inner cylinder and surrounding the inner cylinder, thereby rotatably held by the inner cylinder, and that the rotator is provided with an elastic body repeatedly contacted with and moved away from a projection of the inner cylinder upon rotation of the rotator to generate a click feeling, and that a stopper is arranged on a base part of the screw rod and associated with a lower part of the inner plate when the inner plate is positioned at the lowest end of the content filling space, so that rotation of the rotator is prevented.

The propelling container thus configured can be provided with an outer cylinder which surrounds an area up to a tip end of the circumferential wall part of the rotator and which is fixedly held on the upper part of the inner cylinder in a nonrotatable manner. The outer cylinder is preferably made of a transparent body.

The discharge hole of the dispenser head can comprise: an opening communicated with the content filling space; a barrier wall which is arranged in the middle of the opening at a distance to a periphery of the opening and against which a content to be extruded is pressed; and bridges associated with the barrier wall on one end and with the periphery of the opening on the other end for fixedly holding the barrier wall and for dividing the opening into a plurality of opening sections around the barrier wall. In this case, a step is formed between an upper end of the bridge and an upper end of the opening.

The outer face of the inner cylinder can be provided with a recess which exposes a lower end of the dispenser head to facilitate removal of the lid body from the inner cylinder. As the elastic body, preferably a longitudinal rib-like elastic tongue or a ring spring member is used. The ring spring member is formed by a combination of a pair of elastic arms and grooved lugs. The elastic arms sandwiches an outer circumferential face of a base part reception ring accommodating the base part of the screw rod from two directions, leaving an allowance for displacement relative to the outer circumferential face of the base part reception ring. The grooved lugs are integrally connected to each end of the elastic arms on both ends and biased to be abutted against projections of the inner cylinder. In case of using a ring spring member, at least one end of the grooved lugs is provided with a protrusion contacted with and moved away from the projections of the inner cylinder.

In the propelling container thus configured, the bottom wall part or the circumferential wall part of the rotator is provided with the elastic body, and upon rotation of the rotator, the elastic body is contacted with and moved away from the projection of the inner cylinder at an interval, so that a click feeling is generated and the user can readily recognize how much the content is propelled.

In a state where the inner plate is positioned at the lowermost end of the content filling space, the inner plate is associated with the stopper arranged on the base part of the screw rod to prevent rotation of the rotator, so that no force that can damage the component is exerted on the inner plate. Furthermore, sealing performance of the container is improved by arranging an annular sealing member between the screw rod and the inner plate.

If the discharge hole on the dispenser head is formed as a single opening, the content tends to be heaped when discharged. If a barrier wall having the same contour as that of the opening is arranged in the middle of the opening and fixedly held by bridges which divide the opening into a plurality of opening segments and form a step from the upper end of the opening, the content can be discharged in a less heaped state due to the cooperative effect of the barrier wall and the step. In areas in which the step is formed, the portions into which the content has been divided by the bridges can meet again to be discharged in a form corresponding to that of the discharge hole in the course of reaching the upper end of the opening, so that a decorative effect can be increased.

Furthermore, the present invention also provides a propelling container comprising:

an inner cylinder for accommodating a content, a dispenser head for mounting on a mouth part of the inner cylinder, having a dome-like sectional shape and at least one discharge hole in the middle of the top face, communicated with an inner space surrounded by a side wall; and a lid body detachably engaged with an upper part of the inner cylinder to receive the dispenser head therein, the content in the inner cylinder being appropriately lifted and discharged through the discharge hole of the dispenser head, characterized in that the top face of the dispenser head is provided with a recess including the discharge hole; and that a sealing lid is provided on the back face of the lid body, the sealing lid having a raised wall fitted into the recess of the dispenser head and pressed tightly against the recess of the dispenser head to close the discharge hole when the lid body is mounted; and that an elastic member is disposed between the sealing lid and the lid body and presses the raised wall with its restoring force against the recess of the dispenser head to form a face contact region when the lid body is completely closed.

In the propelling container thus configured, an O-ring having an inside diameter surrounding the whole discharge holes can be used.

In the propelling container according to this embodiment, the raised wall provided on the back face of the lid body abuts against and is adapted to (agreed with) the recess of the dispenser head, so that no gap exists between the lid body and the dispenser head, and thereby the content is not leaked out.

Furthermore, as a result of arranging the elastic member between the sealing lid and the lid body, the raised wall is tightly pressed against the recess of the dispenser head due to the restoring force of the elastic member when the lid body is completely closed, so that a more secure sealing is possible.

BRIEF DESCRIPTION OF THE DRAWINGS

FIG. 3 is a cross-sectional view of the propelling container shown in FIG. 1 with a lid body mounted on;

FIG. 11 is a cross-sectional view of the propelling container shown in FIG. 9 with the lid body mounted on;

REFERENCE SYMBOLS

Figure 1:
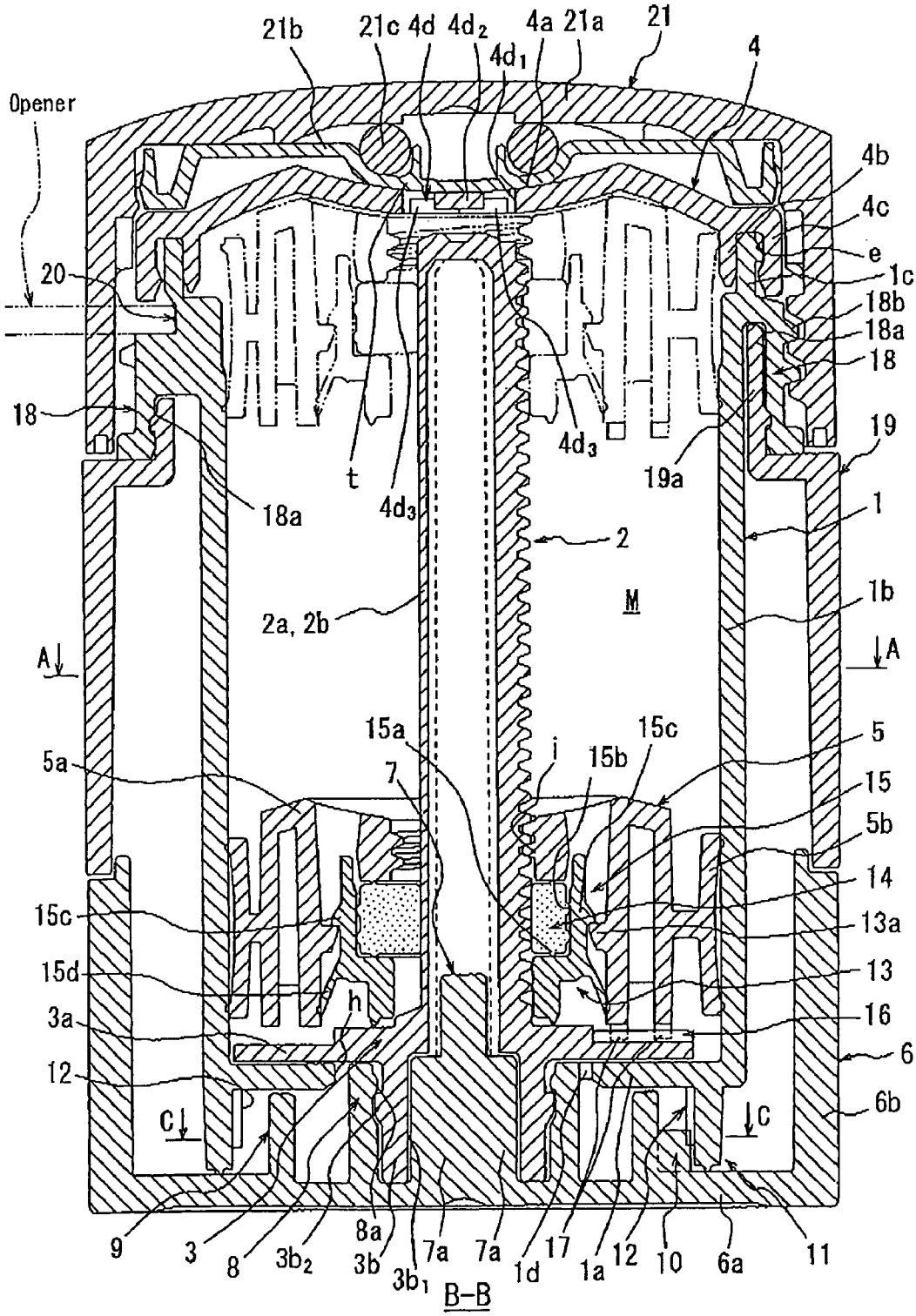
FIG. 1 is a longitudinal sectional view of a propelling container according to an embodiment of the present invention.

1 inner cylinder
1*a* bottom part
1*b* side wall
1*c* mouth part
1*d* rib
2 screw rod
2*a* flat face
2*b* flat face
3 base part
3*a* disc
3*b* cylindrical part
3*b*1 spline shaft
3*b*2 locking claw
4 dispenser head
4*a* recess
4*b* inner wall part
4*c* outer wall part
4*d* discharge hole
4*d*1 opening
4*d*2 barrier wall
4*d*3 bridge
4*e* top face
5 inner plate
5*a* inner plate body
5*b* sliding band
5*c* engaging part
6 rotator
6*a* bottom wall part
6*b* circumferential wall part
7 connecting rod
7*a* longitudinal rib
8 base reception ring
8*a* locking claw
9 wall
9*a* cutout
9*b* cutout
9*c* longitudinal rib
9*d* longitudinal rib

9*e* longitudinal rib
9*f* longitudinal rib
10 elastic body
11 wall
12 projection
13 accommodation concave
14 sealing member
15 retaining member
15*a* face
15*b* face
15*c* claw
16 stopper
17 projection
18 circumferential wall
18*a* annular groove
18*b* thread
19 outer cylinder
19*a* insert member
20 recess
21 lid body
21*a* lid main body
21*b* sealing lid
21*c* elastic member
21*d* raised wall
22 elastic body
22*a* elastic arm
22*b* elastic arm
22*c* lug
22*d* lug
22*e* protrusion
22*f* protrusion
23 plug
24 rib
h through hole
d cylindrical body
e annular groove
K distance
P level difference

BEST MODE FOR CARRYING OUT THE INVENTION

Figure 2:
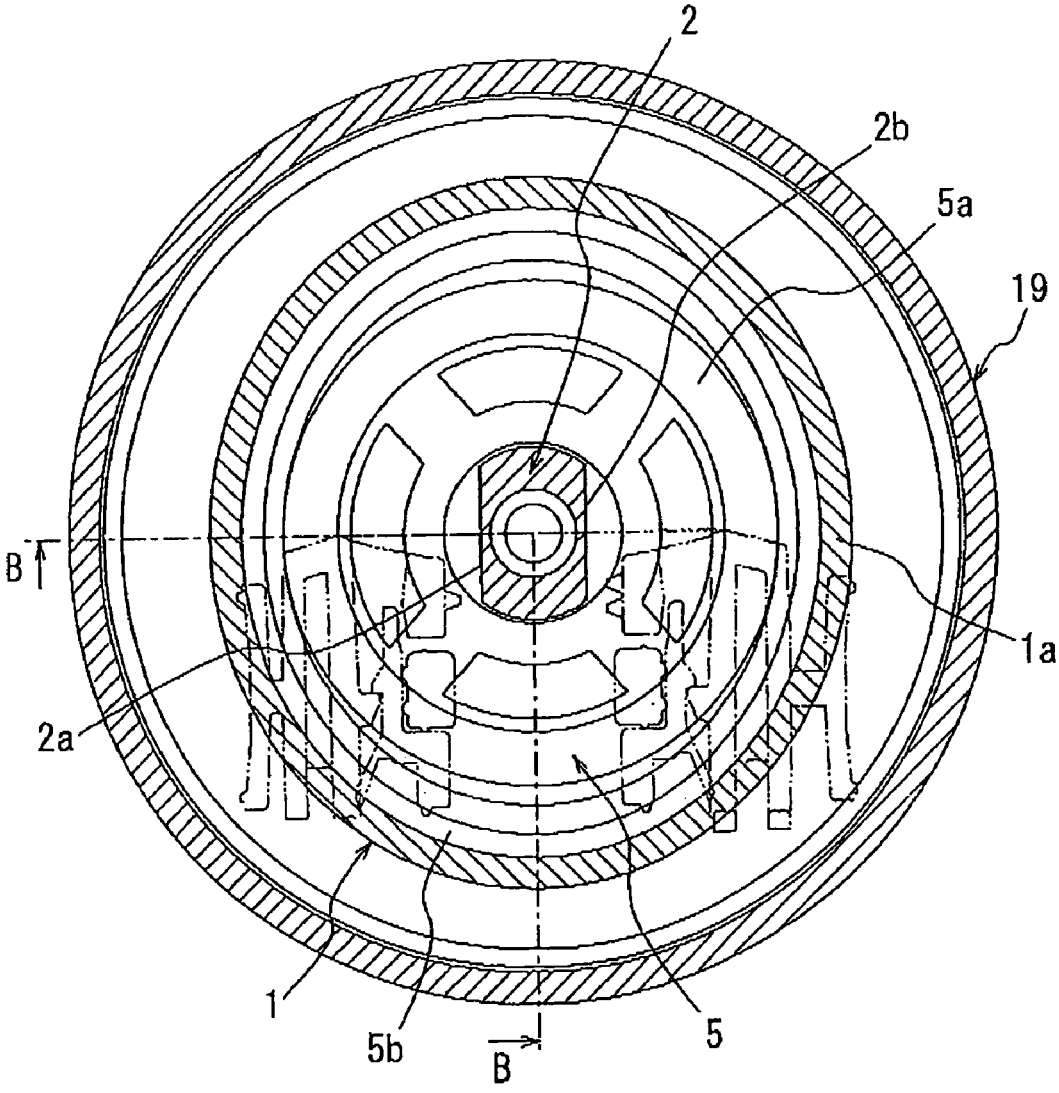
FIG. 2 is a cross-sectional view of the propelling container shown in FIG. 1, showing shape of the recess in plan view.
Figure 3:
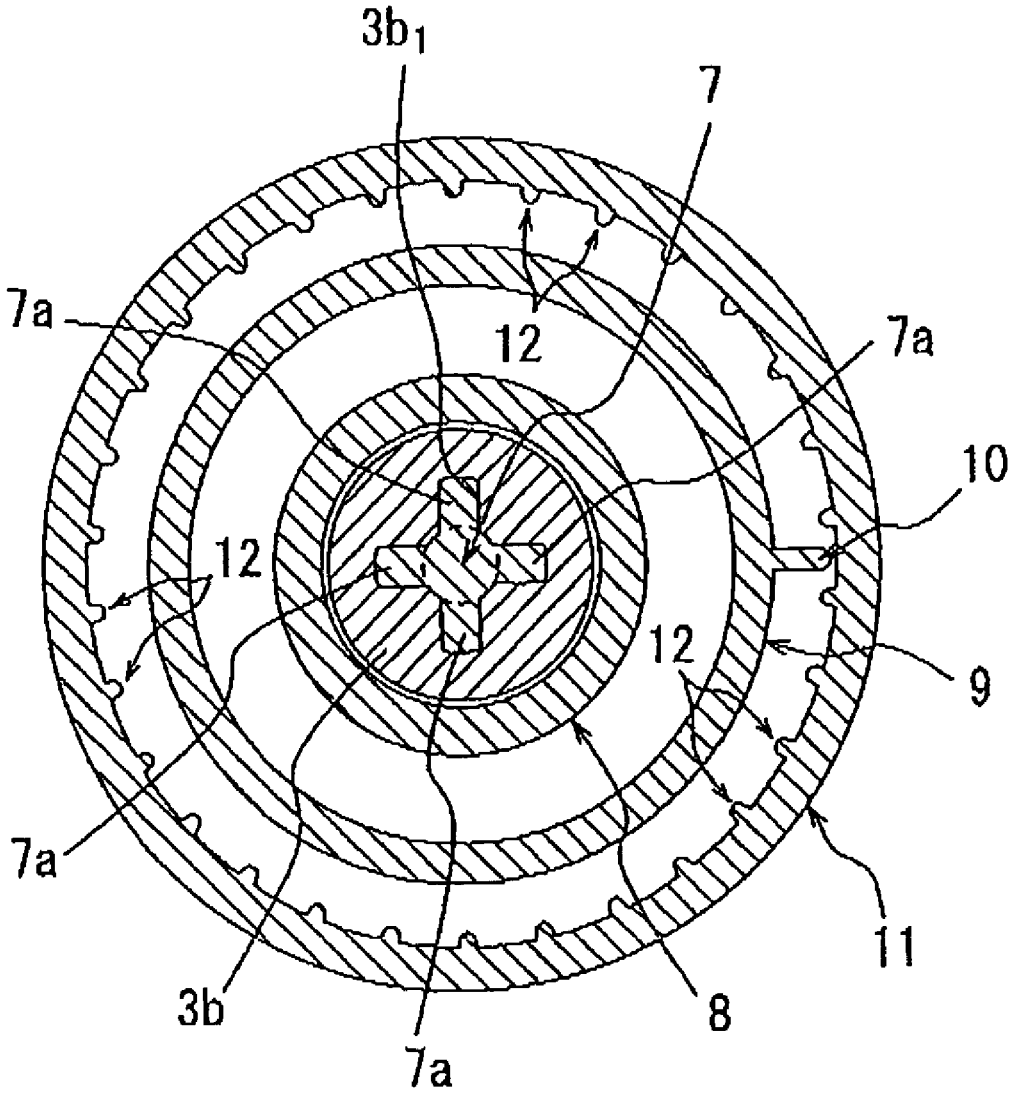
Figure 4:
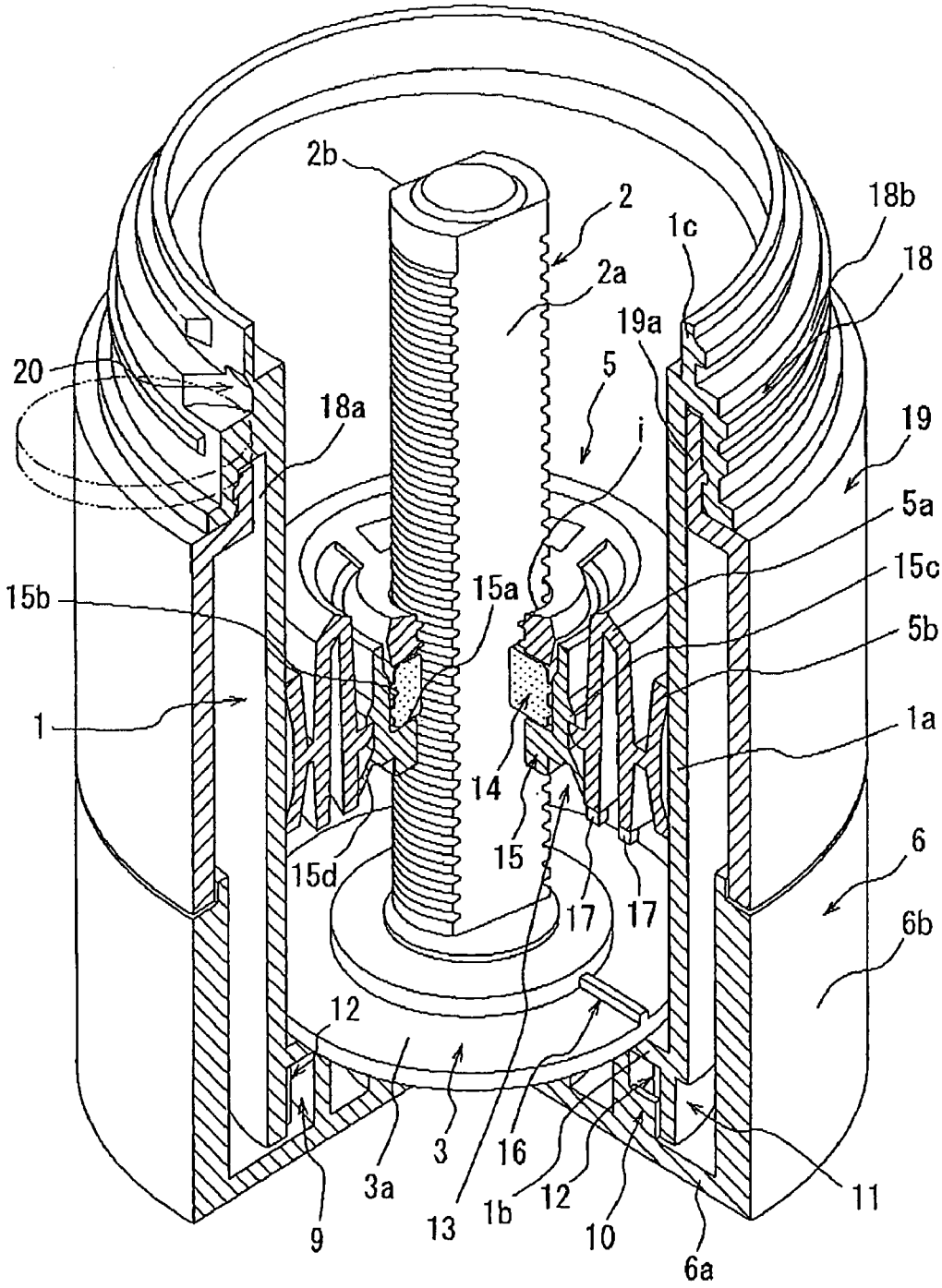
FIG. 4 is a schematic view of the propelling container shown in FIG. 1 showing an abutted state of the sealing lid.

The present invention will be described with reference to the accompanying drawings. FIG. 1 is a schematic, cross-sectional view taken along line B-B in FIG. 2 of a propelling container according to an embodiment of the invention. FIG. 2 is a cross-sectional view taken along line A-A in FIG. 1. FIG. 3 is a cross-sectional view taken along C-C in FIG. 1 and FIG. 4 is a perspective view of the outline of the container shown in FIG. 1, partially shown in cross section.

The reference numeral 1 in the drawings denotes an inner cylinder which forms a body of the container. The inner cylinder 1 comprises a bottom part 1*a* having a through hole h in the middle portion thereof and a side wall 1*b* standing upright from a periphery of the bottom part 1*a*, so that a content filling space M having an elliptic outline in plan view is defined in the inner cylinder 1 (see FIG. 2).

A screw rod 2 is standing rotatably on the bottom part 1*a* of the inner cylinder 1. The screw rod 2 comprises a hollow body having a pair of flat faces 2*a*, 2*b* without a thread on opposite positions thereof, and has a racetrack-like cross section. (see FIG. 2)

A base part 3 is integrally connected to a lower end of the screw rod 2 and uprights the screw rod 2 on the bottom part 1*a* of the inner cylinder 1. The base part 3 comprises a disc 3*a* arranged on the bottom part 1*a* of the inner cylinder 1, and a cylindrical part 3*b* connected to a lower face of the disc 3*a* and projecting outside of the inner cylinder 1 via a through hole h in the bottom part 1*a* of the inner cylinder 1. The cylindrical part 3*b* has a cross-shaped spline groove 3*b*1 formed therein and a locking claw 3*b*2 (See FIG. 1) formed on an outer face thereof.

Furthermore, the reference numeral 4 in FIG. 1 denotes a dispenser head detachably engaged with a mouth part 1*c* of the inner cylinder 1 by means of an undercut engagement and the like. The dispenser head 4 is shown as having a dome-like sectional shape in this embodiment and has a recess 4*a* which is circular or oval in plan view, in the middle region thereof, as well as an annular groove which is formed in the peripheral region thereof by an inner wall part 4*b* and an outer wall part 4*c*, and with which the mouth part 1*c* of the inner cylinder 1 is engaged.

Figure 5A:
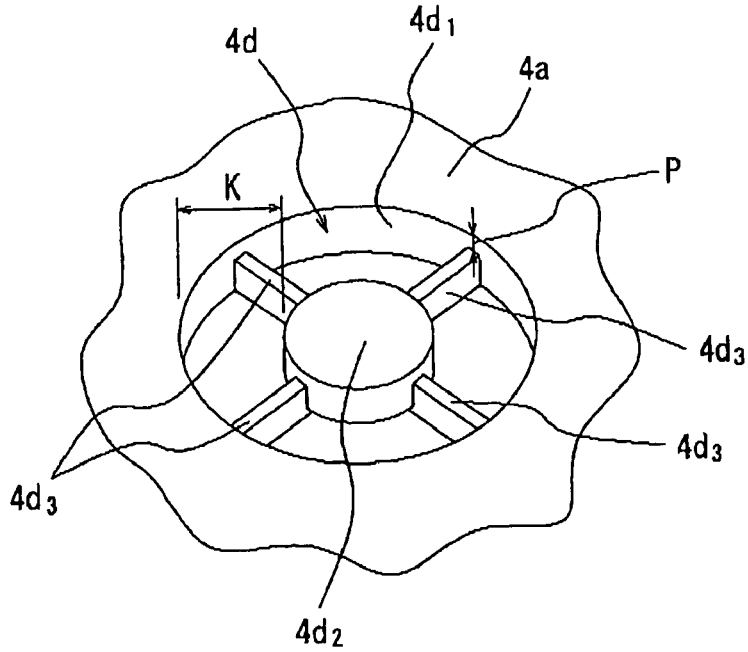
FIGS. 5A and 5B are a perspective view of another embodiment of the propelling container according to the invention.
Figure 5B:
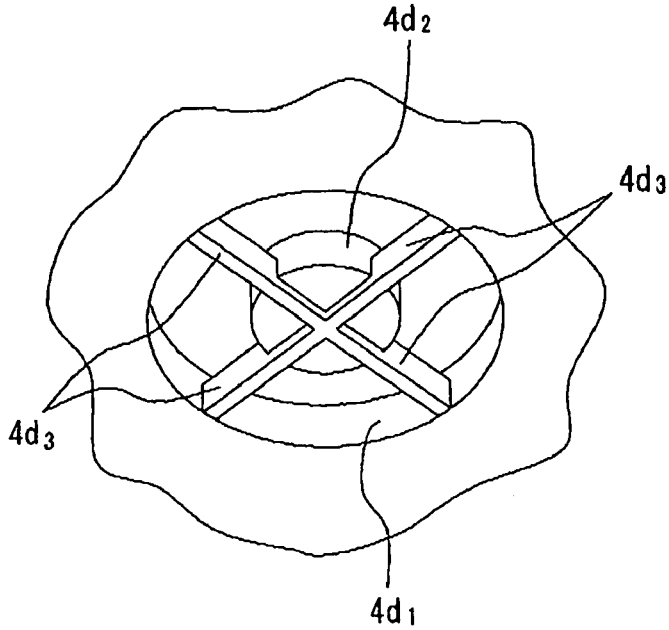

A discharge hole 4*d*, as shown in an enlarged view of its main part in FIGS. 5A and 5B comprise an opening 4*d*1, barrier wall 4*d*2 formed as a disc-like member and arranged in the center the opening 4*d*1 at a distance K from a peripheral part of the opening 4*d*1, and bridges 4*d*3 connected to the barrier wall 4*d*2 on one end as well as to a peripheral part of the opening 4*d*1 on the other end with a level difference P, so that the barrier wall 4*d*2 is fixedly held. A plurality of the bridges 4*d*3 are provided to divide the opening 4*d*1 into a plurality of sections around the barrier wall 4*d*2.

An inner plate 5 has a similar (elliptic) shape as the content filling space M of the inner cylinder 1 in plan view. The inner plate 5 comprises an inner plate body 5*a* having a through hole i for allowing the screw rod 2 to be passed through as well as a threaded part for engagement with the threaded part of the screw rod 2 to extrude the content placed on the inner plate 5 in the content filling space M; and an annular sliding band 5*b* formed integrally on a side wall of the inner plate body 5*a* and elastically contacted with the inner face of the inner cylinder 1 at an upper point and a lower point.

A rotator (a dial) 6 is arranged at a lower part of the inner cylinder 1. The rotator 6 comprises a bottom wall part 6*a* arranged at a distance from the bottom part 1*a* of the inner cylinder 1 and a circumferential wall part 6*b* upwardly extending from the periphery of bottom wall part 6*a* along the outer face of the inner cylinder 1 and surrounding the inner cylinder 1, thereby the bottom wall part 6*a* and the circumferential wall part 6 forming a upwardly open cup-like profile.

A connecting rod 7 is integrally formed in the middle of the bottom wall part 6*a* of the rotator 6. Longitudinal ribs 7*a* forming a cross-like shape are arranged at a distance to each other around the connecting rod 7 to form a spline shaft.

An upwardly open base reception ring 8 surrounds the connecting rod 7 at the bottom wall part 6*a* of the rotator 6. The cylindrical part 3*b* of the base part 3 of the screw rod 2 is inserted into a space in the base reception ring 8, and a locking claw 8*a* formed on the inner wall surface of the base reception ring 8 is engaged with the locking claw 3*b*2 formed on the cylindrical part 3*b*, such that the rotator 6 is undetatchably retained at the lower part of the inner cylinder 1. A plurality of ribs 1*d*, or projections, are arranged at a distance at a through hole h, i.e., at an inner periphery of the bottom part 1*a* of the inner cylinder 1, and ends of the ribs are positioned adjacent to the upper part of the outer wall of the base reception ring 8 to prevent rattling caused by a gap created between the base reception ring 8 and the inner cylinder 1.

A wall 9 is arranged on the bottom wall part 6 of the rotator 6 in such a manner that it surrounds the base reception ring 8, and an elastic body 10 is provided on the outer face of the wall 9. The elastic body 10 is shown as a longitudinal rib-like elastic tongue in this embodiment (hereinafter, the elastic body is also referred to as an elastic tongue 10). A wall 11 is arranged on the lower face of the bottom part 1*a* and protrusions 12 are provided over the entire inner circumferential face of the wall 11 at a predetermined distance. The protrusions 12 comprise portions contacted with a part of the elastic tongue 10 on the wall 9. Upon rotation of the rotator 6, a click feeling is generated by the elastic tongue 10 which is repeatedly contacted with and moved away from the protrusions 12.

As shown in FIG. 1, a downwardly open accommodation concave 13 is provided directly inside a through hole i of the inner plate body 5*a*, and an annular sealing member 14 is mounted on or elastically engaged with the screw rod 2. The annular sealing member 14 is formed as an O-ring, a packing or the like and positioned in the accommodation concave 13 to keep a space adjacent to the screw rod 2 in an air-tight state. The annular sealing member 14 is held by at least two inner faces 15*a*, 15*b* of a retaining member 15 in the accommodation convex 13. A claw. 15*c* and a sealing lip 15*d* are provided on an outer wall of the retaining member 15. The claw 15*c* is engaged with a claw 13*a* provided on an inner wall of the accommodation concave 13 to prevent the retaining member 15 from being detached from the accommodation concave 13 and the sealing lip 15*d* keeps a sealed state of the accommodation concave 13 by elastically contacting with the inner wall of the accommodation concave 13, so that the retaining member 15 and the inner plate body 5*a* are kept in a sealed state to each other.

A stopper 16 such as rib is provided on the upper face of the disc 3*a* of the base part 3, and a projection 17 provided on the lower end of the inner plate body 5*a* has a protrusion associated with the stopper 16. The inner plate body 5*a* is to be associated with stopper 16 when the inner plate 5 is positioned at the lowest end of the content filling space M, thereby preventing rotation of the rotator 6, so that inner plate 5 does not slide downward.

A circumferential wall 18 is formed integrally with the outer wall of the inner cylinder 1, directly under the mouth part 1*c* of the inner cylinder 1 (directly under the outer wall part 4*c* of the dispenser head 4). The circumferential wall 18 forms a downwardly open annular groove 18*a* in cooperation with the outer wall of the inner cylinder 1 between both walls.

An outer cylinder 19 is arranged outside of the inner cylinder 1 with a gap and surrounds the inner cylinder 1 in a region up to an end of the circumferential wall part 6*b* of the rotator 6. An insert member 19*a* is provided on the upper end of the outer cylinder 19 to unrotatably and undetachably lock the outer cylinder 19 in the annular groove 18*a* by an engagement measure such as undercut and a locking measure such as longitudinal rib.

A recess 20 is provided locally on the outer wall of the inner cylinder 1 in a position above the circumferential wall 18. The recess 20 exposes the lower end of the outer wall part 4*c* of the dispenser head 4, so that an opener, for example, a flat member such as coin is inserted into the recess to lift and eliminate the dispenser head 4.

The reference numeral 21 in FIG. 1 denotes a lid body which is engaged with a thread 18*b* of the circumferential wall 18 to keep the container in an encapsulated state. The lid body 21 comprises a lid main body 21*a*, a sealing lid 21*b* and an O-ring 21*c*. The sealing lid 21*b* has a raised part t in the middle part, which is adapted to the recess 4*a* of the dispenser head 4, and is undetachably retained on the rear face of the lid main body 21*a*. The sealing lid 21*b* is elastically held by the O-ring 21*c* on the rear face. When the lid body 21 is completely closed, the raised part t of the sealing lid 21*b* is brought into elastic contact with the recess 4*a* of the dispenser head 4, so that the dispenser opening of the dispenser head 4 is maintained in an air-tight or a fluid-tight state.

In the above-mentioned expansion container, an annular sealing member 14 is disposed between the inner plate 5 and the screw rod 2, so that the content filling space M is maintained in an air-tight or a fluid-tight state when the lid body 21 is closed. As a result, even if a liquid with relatively low viscosity is filled as a content, the content is not leaked out, and in spite of the content containing a volatile component, volatilization of the component can be avoided.

If the rotator 6 is to be rotated in an opposite direction by mistake when the inner plate 5 is positioned at the lowest end of the inner cylinder 1 as shown in FIG. 1, the stopper 16 provided on the disc 3*a* is engaged with the projection 17 on the lower end of the inner plate 5 (inner plate body 5*a*) to prevent rotation of the rotator 6, so that the components are not damaged.

When the rotator 6 is rotated to slide the inner plate 5 toward the dispenser head 4 and to extrude the content within the content filling space M from the discharge hole 4*d*, the elastic tongue 10 provided on the wall 9 is repeatedly contacted with and moved away from the projection 12 of the wall 11, and thereby the click feeling is generated, so that it is easy to recognize the amount of the content propelled. The content is discharged from the discharge hole 4*d* in a less heaped-up state.

When the outer cylinder 19 is formed as a transparent body, it is possible to visually recognize the residual of the content, and a good appearance can be given to the container. In that case, the inner cylinder 1 can be formed as a semi-transparent body (the inner cylinder can be also colored).

While the elastic tongue 10 is provided on the wall 9 and the convex 12 is provided on the wall 11 according to the embodiment of the present invention, it is also possible, without limitation, to provide the elastic tongue 10 and the convex 12 in an opposite way.

The inner plate 5 and the inner cylinder 1 are elliptic in plan view, so that their co-rotation upon rotation of the screw rod 2 is prevented, but they do not necessarily have to be elliptic and their shape can be varied optionally, so long as it is possible to provide a structure that prevents the co-rotation of the both members.

Figure 6:
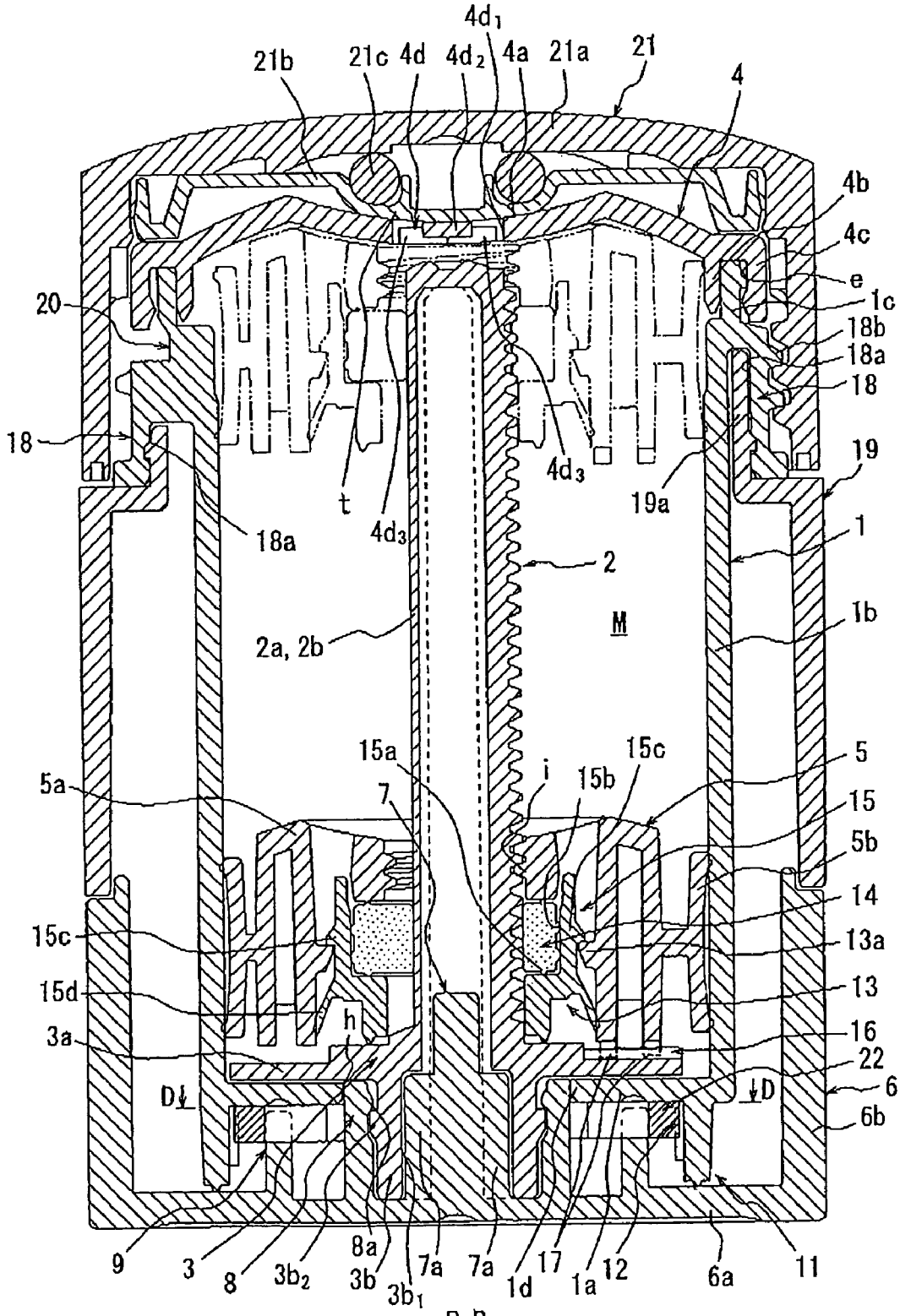
FIG. 6 is a longitudinal sectional view of another embodiment of the propelling container according to the invention taken along line B-B in FIG. 2.
Figure 7:
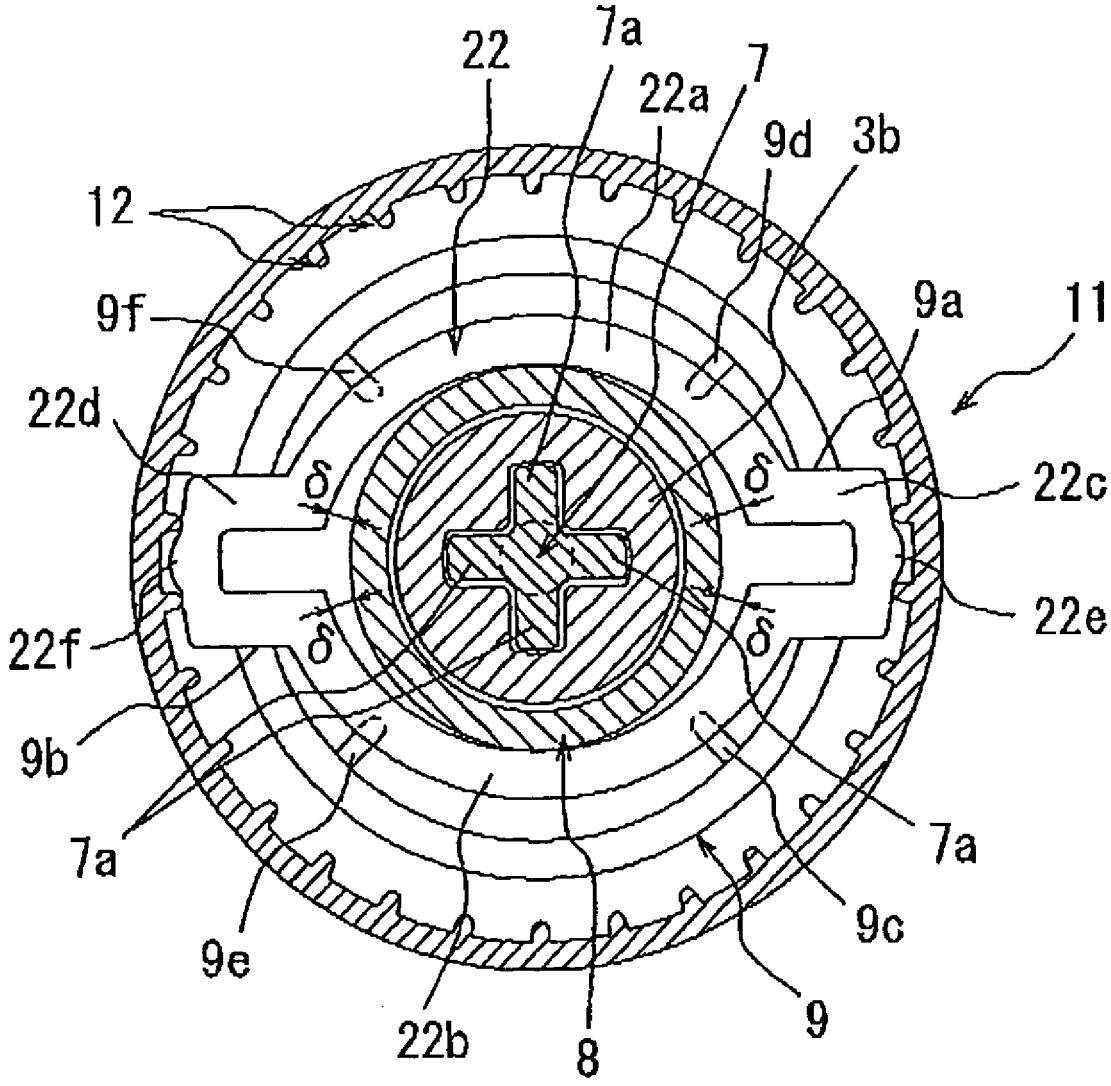
FIG. 7 is a cross-sectional view of the propelling container taken along line D-D of FIG. 6.
Figure 8:
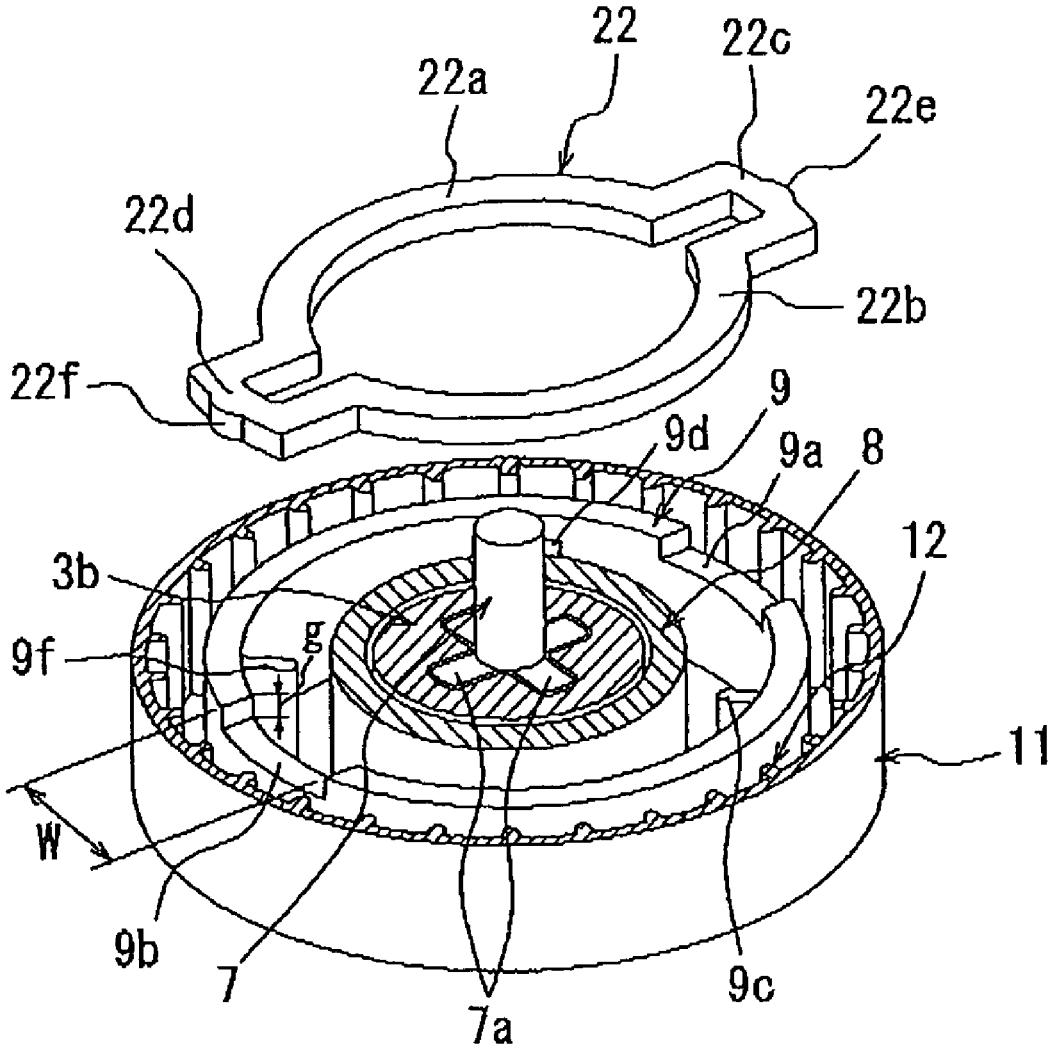
FIG. 8 is a perspective view of an elastic member.

FIG. 6 is a cross-sectional view of the propelling container according to another embodiment of the present invention (a cross-sectional view taken along line B-B in FIG. 2), and FIG. 7 is a cross-sectional view taken along line D-D in FIG. 6, and FIG. 8 is a perspective view.

The reference numeral 22 in the drawings denotes an elastic body for generating the click feeling in accordance with rotation of the rotator 6. The elastic body 22 is formed of a ring spring member which is unrotatably fitted into cutouts 9*a*, 9*b* formed on opposite portions of the wall 9 and then mounted and positioned on the longitudinal ribs 9*c*, 9*d*, and 9*f*. The elastic body 22 comprises a pair of elastic (curved) arms 22*a*, 22*b* for sandwiching the outer circumferential face of the base reception ring 8 from two directions, leaving an allowance for a displacement 8 relative to the outer circumferential face of the base reception ring 8 (see FIG. 7); and grooved lugs 22*c*, 22*d* integrally connected to each end of both elastic arms 22*a*, 22*b* and biased to be abutted against the projection 12 of the inner cylinder. Protrusions 22*e*, 22*f* are provided integrally on each end of the grooved lugs 22*c*, 22*d*.

The elastic body (ring spring member) 22 is biased such that the grooved lugs 22*c*, 22*d* provided on both ends of the elastic arms 22*a*, 22*b* can be abutted against the projection 12. While the protrusions are contacted with the projection 12 by the rotation of the rotator 6, pressure is exerted on the protrusions 22*e*, 22*f*, so that they can slide smoothly along the outer face of the projection 12, and hence generate the click feeling, thereby bringing about a high-class image.

The elastic body (ring spring member) 22 shown in FIG. 6 to FIG. 8, includes the protrusions 22*e*, 22*f* on both ends of the lugs 22*c*, 22*d*, respectively, but is not limited to this and it may be sufficient to provide the protrusion 22*e* or 22*f* on either lug 22*c* or 22*d* instead of providing them in two positions.

The width W and the depth g (see FIG. 8) of the cutouts 9*a*, 9*b* are preferably adapted to the width and the depth of the lugs 22*c*, 22*d*, so that no gap is created between both members, and thereby generation of "rattling" and the accompanying sound is avoided.

Another embodiment will be described now with reference to FIG. 9. The reference numeral 1 in the drawing denotes an inner cylinder. On the bottom part 1*a*, the inner cylinder 1 comprises a bottom wall part 6*a* arranged at a distance from the bottom part 1*a* of the inner cylinder 1 and a circumferential wall part 6*b* standing upright (extending) from the periphery of the bottom wall part 6*a* along the outer face of the inner cylinder 1 and surrounding the circumference of the inner cylinder 1. Furthermore, a propelling mechanism is integrated in the inner cylinder, comprising a rotator 6 rotatably held on an end of the inner cylinder 1, a screw rod 2 standing in the middle of the bottom wall part 6*a* of the rotator 6 and rotating synchronously with rotation of the rotator 6, an inner plate 5 engaged with the screw rod 2 and downwardly and upwardly movable within the inner cylinder by rotating the rotator 6, a sliding band 5*b* having a rib or a ditch J' connected integrally to the periphery of the inner plate 5 and engaged with a rib or a ditch J provided on the inner wall of the inner cylinder 1, for guiding a linear, upward and downward movement of the inner plate 5.

Figure 9:
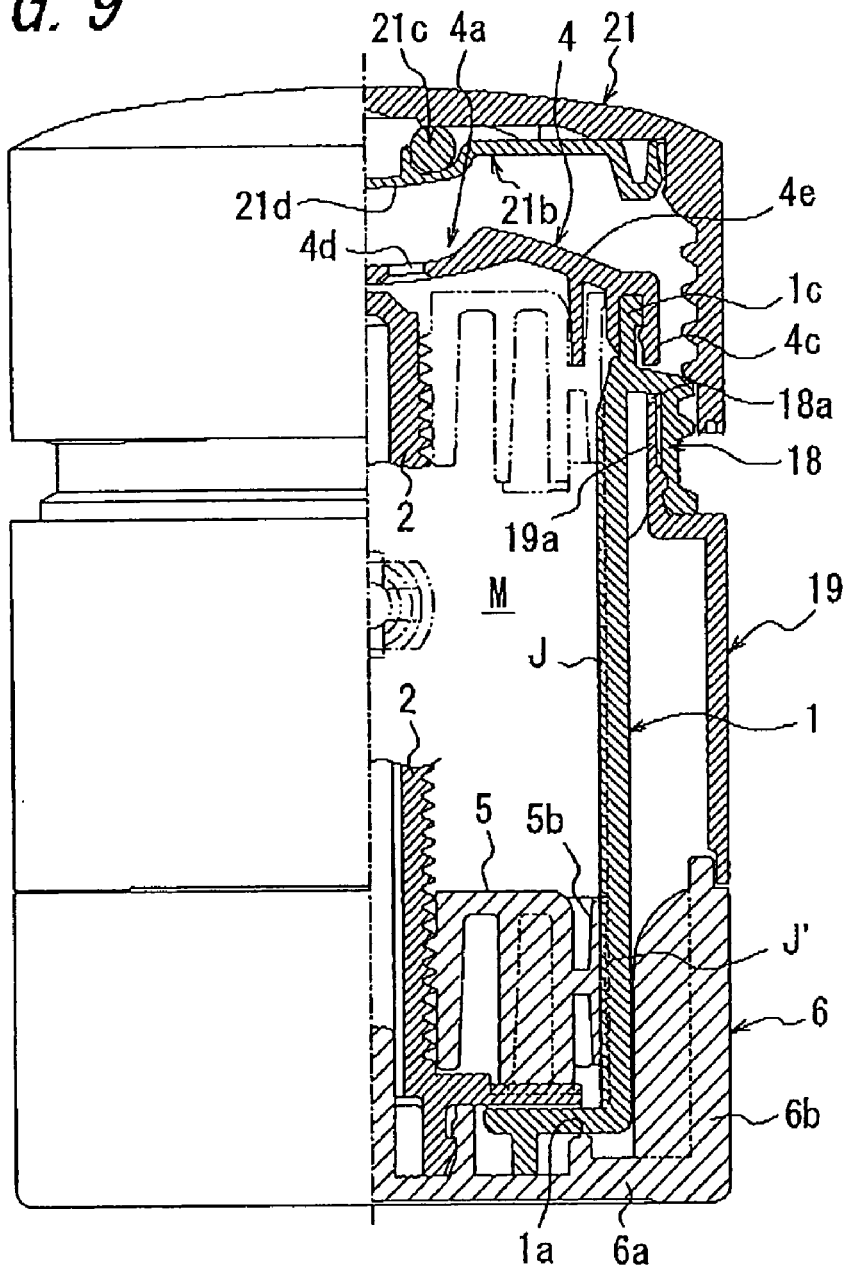
FIG. 9 is a cross-sectional view of the propelling container according to another embodiment of the present invention.

The screw rod 2 described above is exemplarily shown as having parallel flat faces formed on the opposed portions, as indicated by imaginary lines in FIG. 9. However, a screw rod is not limited to the one shown in the drawing, but a screw rod having a circular cross section (perfect circle) similar to a common propelling container can be also used.

A dispenser head, denoted by the reference numeral 4, comprises a top face 4*e* and an outer wall part 4*c* connected integrally with the periphery of the top face 4*e*, and mounted on the mouth part 1*c* of the inner cylinder 1 (an undercut engagement or screw engagement is possible). A plurality of discharge holes 4*d* communicated with the inside of the inner cylinder 1 are provided in the middle of the top face 4*e* of the dispenser head 4 having a dome-like sectional shape. It is not necessary to provide a plurality of the discharge holes 4*d*, but it may be sufficient to provide at least one discharge hole 4*d*. The number of the discharge holes 4*d* can be varied in accordance with viscosity of a content or usage.

Figure 10:
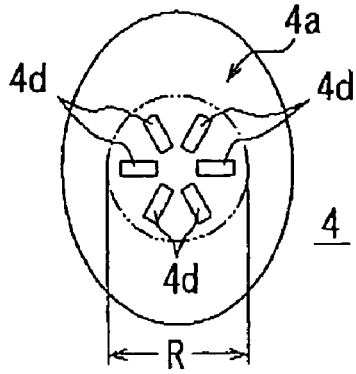
FIG. 10 is a plan view of a recess of the propelling container shown in FIG. 9.

The reference numeral 4*a* indicates a recess provided on the top face 4*e* of the dispenser head 4. The recess 4*a* has an elliptic shape, as shown in FIG. 10, and the content is scooped by touching the recess 4*a* by tip of a finger and sliding the finger along the face of the recess.

A circumferential wall 18 is provided integrally with the outer wall of the inner cylinder 1 directly under the mouth part 1*c* of the inner cylinder. The circumferential wall 18 forms a downwardly open annular groove 18*a* in cooperation with the outer wall of the inner cylinder 1 between both walls.

An outer cylinder 19 is arranged outside of the inner cylinder 1 with a gap, thereby surrounding the inner cylinder 1 in a region up to an the end of the circumferential wall part 6*b* of the rotator 6. An insert member 19*a* is provided on the upper end of the outer cylinder 19 to unrotatably and undetachably lock the outer cylinder 19 in the annular groove 18*a* by an engagement measure such as undercut and a locking measure such as longitudinal rib. The outer cylinder 19 and the inner cylinder 1 form a container body. The outer cylinder 19 and the inner cylinder 1 can be also formed integrally.

The reference numeral 21 denotes a lid body detachably engaged (threaded) with the circumferential wall 18, and the reference numeral 21*b* denotes a sealing lid arranged on the back face of the lid body 21. The sealing lid 21*b* has a circular raised wall 21*d* adapted to the recess 4*a* of the dispenser head 4 and is undetachably retained on an upper part of the inner face of the lid body 21.

An elastic member 21*c* is shown as an O-ring arranged between the lid body 21 and the sealing lid 21*b* by way of example. The elastic member 21*c* has an inside diameter R and surrounds the whole discharge holes 4*d* (see FIG. 10). If the lid body 21 is completely closed, the raised wall 21*d* is pressed by the elastic member 21*c* with its restoring force against the recess 4*a* to form a face contact region (sealed part) P (see FIG. 11).

The propelling container according to the above embodiment has a content filling space M defined in a region surrounded by the inner wall of the inner cylinder 1, inner plate 5 and the dispenser head 4, and the content (not shown) existing in the content filling space M is extruded from the discharge holes 4*d* of the dispenser head 4 by rotating the rotator 6 and sliding the inner plate 5 upwardly by the screw rod.

Figure 11:
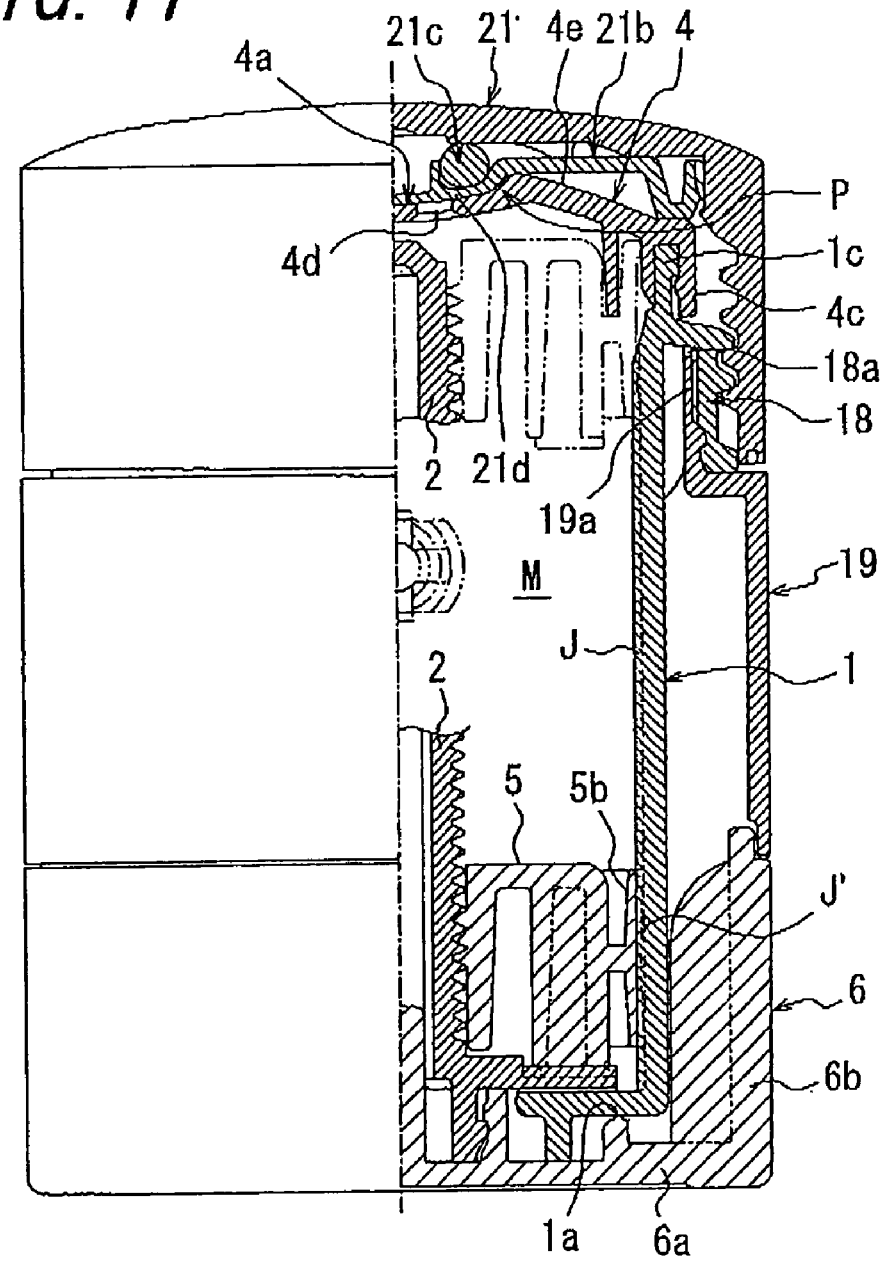
Figure 12:
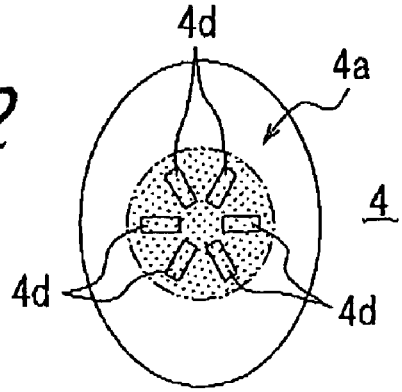
FIG. 12 is a cross-sectional view of the propelling container shown in FIG. 9 showing an abutted state of the sealing lid.

When the lid body 21 is tightly mounted on the lid body 21, the raised wall 21*d* of the seal lid 21*b* arranged on the lid body 21 is fitted into the recess 4*a* of the dispenser head 4, as shown in FIG. 11. By further tightening of the lid body 21 (by tightening allowance of the O-ring), the raised wall 21*d* is pressed tightly against the recess 4*a* due to the restoring force of the elastic member 21*c* (face contact), so that secure sealing is achieved.

With respect to the raised wall 21*d* and the recess 4*a*, the curvature of the raised wall 21*d* is preferably larger than that of the recess 4*a*, and thereby, in the process of tightening the lid body 21, the raised wall 21*d* is firstly brought into line contact with the recess 4*a* in a region where the discharge holes 4*d* are surrounded by the raised wall 21*d*. By a further tightening of the lid body 21, the elastic member 21*c* positioned between the lid body 21 and the sealing lid 21*b* presses the raised wall 21*d* of the seal lid 21*b*, and if the lid body 21 is completely tightened, the raised wall 21*d* is tightly pressed against the recess 4*a* by the restoring force of the elastic member 21*c* (face contact), so that a secure sealing is achieved.

Although the top face 4*e* of the dispenser head 4 in the embodiment above is described as having a recess 4*a* which is elliptic in plan view, the shape of the recess 4*a* is not limited to this, but can be varied appropriately with respect to design and usability. The present invention is preferably used as a sealing mechanism for a dispenser head 4 having a recess 4*a* with a profile other than perfect circle. Although the elastic member 21*c* is shown as an O-ring in the embodiment above by way of example, any shape can be selected, so long as the raised wall 21*d* of the seal lid 21*b* is tightly pressed against the recess 4*a* when the lid body 21 is completely tightened.

Figure 13:
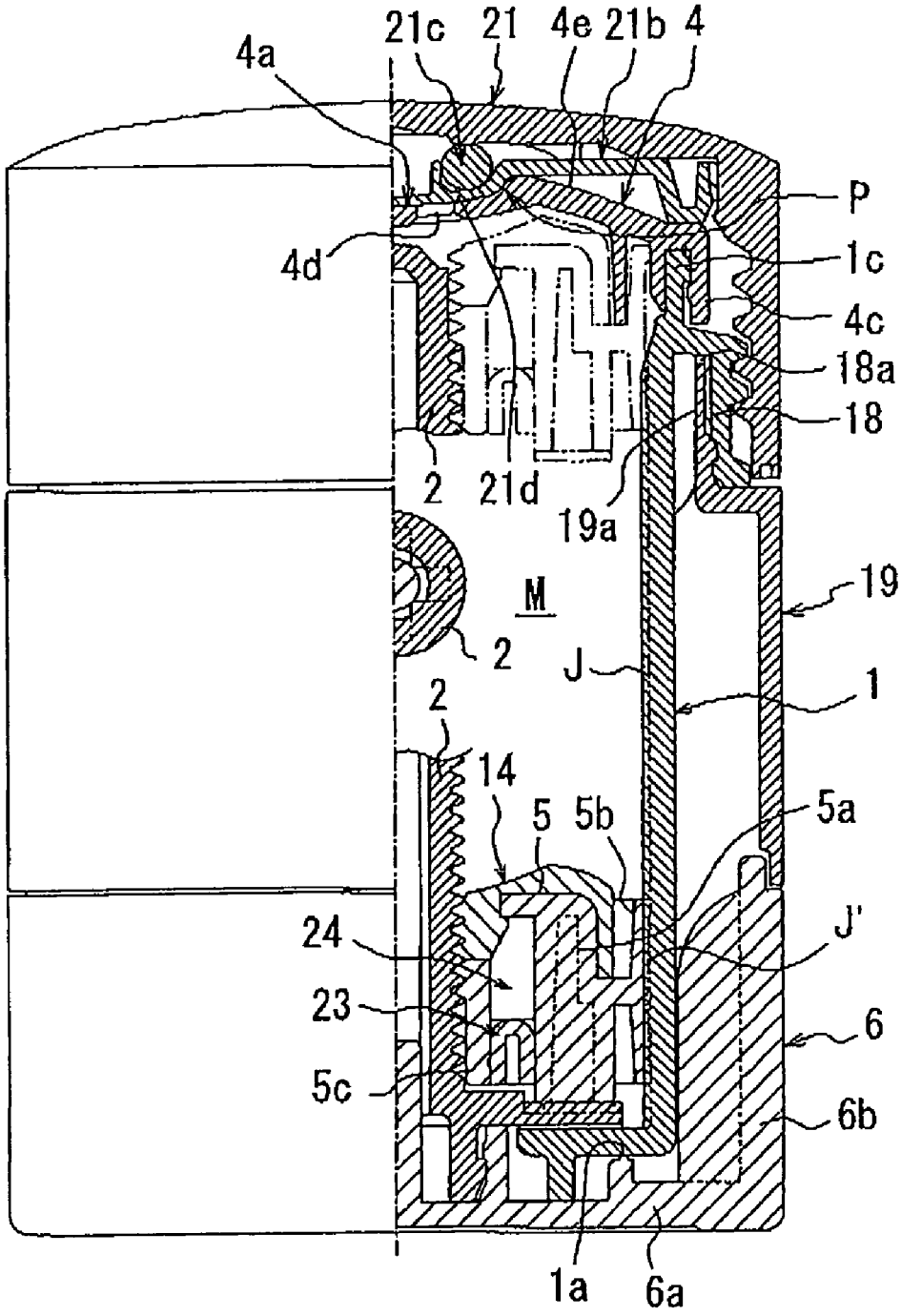
FIG. 13 is a cross-sectional view of another embodiment of the propelling container according to the invention.

FIG. 13 shows another embodiment of the propelling container, in which the screw rod 2 having a circular (perfectly circular) cross section is used and the sealing member 14 having a thread for engagement with the screw rod 2 is arranged on the upper face of the inner plate 5.

In this embodiment, the sealing member 14 is arranged on the inner plate 5, which comprises an engagement part 5*c* engaged with the screw rod 2 over the entire circumference thereof, and an inner plate body 5*a* surrounding the engagement part 5*c* and integrally connected to the engagement part 5*c* by a plurality of ribs 24 arranged at a distance. In the propelling container according to this embodiment, a plug body 23 can be provided on a lower side of a gap formed between the engagement part 5*c* and the plate body 5*a*, so that an air-tight sealing is complimentarily ensured if the sealing member 14 is deformed to reduce a sealing performance upon upward and downward movements of the inner plate 5, and a sealing at the engagement part with the screw rod is also ensured in cooperation with the sealing member 14.

In the propelling container shown in FIG. 13, the discharge holes 4*d* are securely sealed by the elastic member 21*c* and the sealing lid 21*b*, and the sealing member 14 is arranged on the inner plate 5, so that the sealing performance of the content filling space M is considerably improved, and thus, the propelling container is particularly suitable for accommodating a highly volatile content.

Upon mounting the sealing member 14 on the inner plate 5, the separately formed sealing member 14 is fitted and mounted on the inner plate 5 formed in a manner as described above, or an insert molding method and the like is used, in which either the preformed sealing member 14 or the inner plate 5 may be placed in a mold as an insert member, and the other member may be injected into the mold to form an integral body.

If an embodiment is used in which the gap formed between the engaging part 5*c* of the inner plate 5 and the inner plate body 5*a* is filled and the sealing member 14 is fused to the inner plate 5, the plug can be omitted.

Furthermore, it is preferable to use a flexible material for the elastic member 21*c* and the sealing member 14, and in particular, rubber or thermoplastic elastomer (elastomer of olefin series, styrene series, ester series and the like) are preferred.

Industrial Applicability

A propelling container with high sealing performance can be provided and it is possible to recognize by a click feeling how much the content in the container is discharged. The propelling container is provided, which can increases the sealing performance between the lid body and the dispenser head when the lid body is fastened.

What is claimed is:

1. A propelling container comprising:

an inner cylinder having a screw rod rotatably standing on a bottom part of the inner cylinder and an inner space surrounded by a side wall and serving as a content filling space;

a dispenser head detachably attached to a mouth part of the inner cylinder and having at least one discharge hole communicated with the content filling space;

an inner plate threadedly engaged with the screw rod and having an annular sliding band elastically contacted with an inner face of the side wall of the inner cylinder;

an annular sealing member arranged in the inner plate for keeping an air tight state between the inner plate and the screw rod;

a rotator for rotating the screw rod via a connecting rod to slide the inner plate along an axis of the screw rod with the air tight state being kept so that the content in the content filling space is lifted and discharged from a dispenser opening of the dispenser head; and a lid body detachably engaged with an upper part of the inner cylinder to accommodate the dispenser head therein, wherein the rotator comprises a bottom wall part connected to a lower end of the connecting rod, and a circumferential wall part extending from a periphery of the bottom wall part along an outer face of the inner cylinder and surrounding the inner cylinder, thereby rotatably held by the inner cylinder, and that the rotator is provided with an elastic body repeatedly contacted with and moved away from a projection of the inner cylinder upon rotation of the rotator to generate a click feeling, and that a stopper is arranged on a base part of the screw rod and associated with a lower part of the inner plate when the inner plate is positioned at the lowest end of the content filling space, so that rotation of the rotator is prevented, and wherein the elastic body is formed as a ring spring member consisting of a combination of a pair of elastic arms and grooved lugs, the elastic arms sandwiching an outer circumferential face of a base part reception ring accommodating the base part of the screw rod from two directions, leaving an allowance for displacement relative to the outer circumferential face of the base part reception ring, and the grooved lugs being integrally connected to each end of the elastic arms on both ends and biased to be abutted against projections of the inner cylinder; and that at least one end of the grooved lugs is provided with a protrusion.

2. The propelling container according to claim 1, wherein an outer cylinder surrounding an area up to a tip end of the circumferential wall part of the rotator is provided, and undetachably locked on the upper part of the inner cylinder in a nonrotatable manner.

3. The propelling container according to claim 2, wherein the outer cylinder is made of a transparent body.

4. The propelling container according to claim 1, wherein the discharge hole of the dispenser head comprises: an opening communicated with the content filling space; a barrier wall which is arranged in the middle of the opening at a distance to a periphery of the opening and against which the content to be extruded is pressed; and bridges associated with the barrier wall on one end and with the periphery of the opening on the other end for fixedly holding the barrier wall and for dividing the opening into a plurality of opening sections around the barrier wall, and a step is provided between an upper end of the bridge and an upper end of the opening.

5. The propelling container according to claim 1, wherein the outer face of the inner cylinder is provided with a recess exposing a lower end of the dispenser head to facilitate removal of the dispenser head from the inner cylinder.

6. The propelling container according to claim 1, wherein the elastic body is formed as a longitudinal rib-like elastic tongue.

* * * * *